United States Patent [19]

Carlson

[11] 4,050,137

[45] Sept. 27, 1977

[54] BOWSTRING CHANGER CABLE FITTING

[75] Inventor: John A. Carlson, Wichita, Kans.

[73] Assignee: Conchemco, Incorporated, Lenexa, Kans.

[21] Appl. No.: 666,580

[22] Filed: Mar. 15, 1976

[51] Int. Cl.[2] ..... B23P 19/02

[52] U.S. Cl. ..... 29/235; 124/23 R

[58] Field of Search ..... 124/90, 80, 86, 23 R, 124/24 R, 22; 29/235

[56] References Cited

U.S. PATENT DOCUMENTS

| | | | |
|---|---|---|---|
| 3,207,145 | 9/1965 | Browning et al. | 124/23 R |
| 3,253,587 | 5/1966 | Pearson | 124/23 R |
| 3,294,078 | 12/1966 | Allen | 124/23 R |

*Primary Examiner*—Richard C. Pinkham
*Assistant Examiner*—William R. Browne
*Attorney, Agent, or Firm*—Schmidt, Johnson, Hovey & Williams

[57] ABSTRACT

A string changer cable for compound bows has a pair of tubular members of split-sleeve construction for engaging the tension cables of the compound bow as well as the bowstring holders. Each tubular member has an elongate slot providing tension cable access to an inner tapered passage which captively holds the tension cable during the string changing operation.

5 Claims, 6 Drawing Figures

BOWSTRING CHANGER CABLE FITTING

This invention relates to devices for changing the bowstring in compound bows and the like, and more particularly, concerns a string changer cable of the type having a pair of opposed engaging members interconnected by a flexible restraining cable.

A typical compound bow comprises a flexible cable and pulley system for flexing the limbs of the bow and a stretch of bowstring extending through the nock point of the bow for engagement with arrows of standard construction. In this manner, the archer is provided with the advantages of the compound bow construction while at the same time being presented with handling characteristics of a conventional bow in the nock area. Because the bowstring is typically comprised of a material such as dacron or the like, it must be replaced from time-to-time at a frequency much greater than replacement of the flexible steel cable. For this reason, and since complete breakdown of a compound bow is a rather complicated procedure, it has been desirable to provide some type of device for maintaining the tension in the cable and pulley assembly of a compound bow when the bowstring is removed for replacement; such a device is commonly referred to as a string changer cable.

Prior art string changer cables comprise essentially a flexible steel cable having a pair of S-shaped hooks secured to loops formed in opposite ends of the cable. These S hooks are coupled to respective bowstring holders in a compound bow when it is desired to remove or change the bowstring thereof. Manifestly, the S-shaped hooks require eyelet structure for adequate coupling; in many compound bows the eyelet structure required for engagement of the hooks is present in the form of bowstring holders having a similar S-hook configuration. In this connection, the bowstring is coupled to one end of the S hook string holder, while the opposite end of the holder is secured to a loop in the tension cable assembly; the opposite end of the hook, while providing a means of attachment to the tension cable assembly, also presents eyelet structure which is engageable by the S hook of the conventional string changer cable.

Due to weight, strength, and operational characteristics, a number of improved string holders have been developed for use in compound bows. Many of these improved string holders have no eyelet structure such as provided by the S hook string holders and, as a consequence, these improved string holders are not compatible with conventional S hook string changer cables. It will be apparent that attempts to use the conventional string changers with string holders devoid of any eyelet structure, would be cumbersome as well as extremely dangerous. Not only would it be difficult, if not impossible, to initially couple the S hooks to the improved holders, but also there would exist the hazard of premature release at any moment during the string-changing operation as the force transmitted through the coupled S hooks and holders is increased. Such a premature release could result in bow damage or severe operator injury.

Accordingly, it is an important object of the present invention to provide a string changer cable which positively engages the string holders of a compound bow irregardless of the specific configuration of the string holders.

In accordance with the above objects it is yet another important object of my invention to provide a string changer cable having a pair of opposed, engaging members wherein each member is adapted to envelop a portion of the tension cable itself when in engagement with the string holder, to enhance the gripping action of the member as well as guard against premature release.

It is yet another important object of the instant invention to provide a string changer aas above wherein each member has a split-sleeve construction such that the member may be easily placed around the tension cable.

Figure 1:
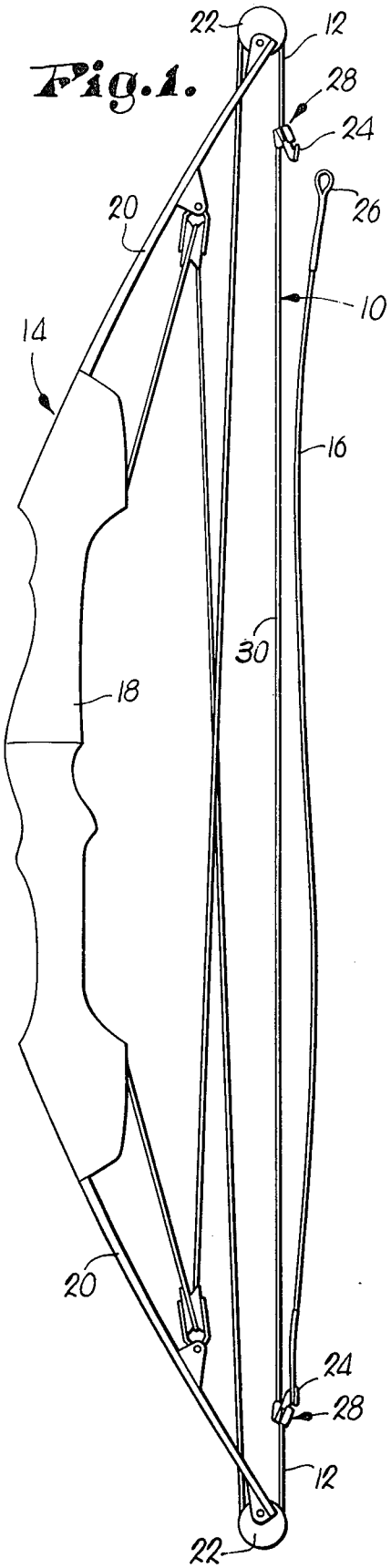
FIG. 1 is a side elevational view of a compound bow showing a string changer constructed in accordance with the present invention and positioned in engagement with the respective string holders.

In FIG. 1, a string changer cable 10 is shown extending between opposed tension cables 12 of a compound bow 14. As shown, a bowstring 16 is partially removed from the compound bow 14. The compound bow 14 is of conventional construction having a handle section 18 supporting a pair of opposed limbs 20, each having a pulley 22 eccentrically mounted at the outermost end thereof. The terminal ends of tension cables 12 are provided with a bowstring holder 24 rigidly secured thereto for engagement with a loop 26 on bowstring 16. Each holder 24 includes structure 25 which rigidly secures the holder to its respective tension cable 12. Cables 12 are arranged around pulleys 22 and other bow structure in such a manner that string holders 24 are biased toward pulleys 22 on the respective outermost ends of limbs 20. By virtue of this arrangement, bowstring 16 is normally held in tension between the string holders 24.

String changer cable 10 includes a pair of opposed engagement members 28 interconnected by a length of flexible nylon covered steel cable 30. Each member 28 is of split-sleeve construction, being tubular and having wall structure comprising a flat rear section 31, a generally flat side section 33 extending substantially perpendicular from rear section 31, and an arcuate front section 35 contiguous with side section 33 and facing rear section 31. Sections 31, 33 and 35 are arranged to define a generally cylindrical, elongate passage 32 which extends the the length of member 28. The arcuate front section 35 terminates on one end, presenting an edge 37 spaced from the rear section 31 to define an elongate slot 34 in communication with passage 32. Each member 28 also has a pair of opposed end faces 36 and 39 respectively. It is to be understood that both the diameter of passage 32 and the width of slot 34 are greater than the diameter of cables 12 so that members 28 may be placed over cables 12 in a releasable engaging position. Moreover, the diameter of passage 32 is of a dimension smaller than the maximum dimension of structure 25 such that member 28 is restrained from movement along cable 12 beyond the interface between structure 25 and cable 12.

Figure 4:
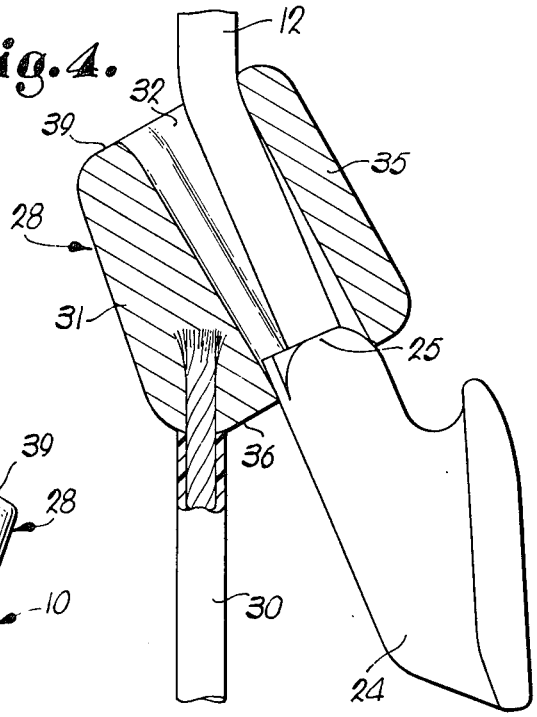
FIG. 4 is an enlarged, cross-sectional view showing one of the engagement members positioned against one of the string holders shown in FIG. 1.

As shown in FIG. 4, cable 30 is integrally coupled to member 28 at a point in rear section 31 adjacent end face 36 in such a manner as to extend obliquely of the axis of passage 32. By this arrangement, members 28 are canted when tension is applied to cable 30 such that a gripping action is imparted upon cable 12 by front and rear sections 35, 31. In the preferred embodiment passage 32 is slightly tapered in a direction toward end face 36 to facilitate positioning of the member 28 over the cable, as well as to reduce the possibility of kinking the cable 12.

Figure 5:
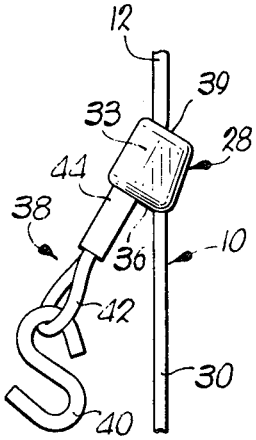
FIG. 5 is a partial side elevational view showing the device of FIG. 1 in engagement with an S-shaped hook type string holder.
Figure 3:
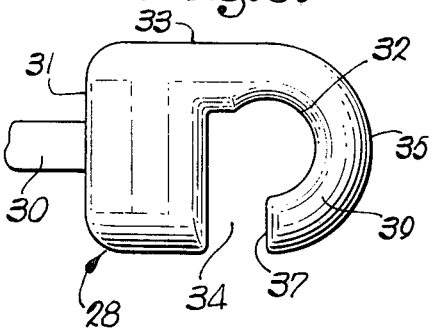
FIG. 3 is an enlarged plan view showing one of the engagement members.

In FIG. 5, string changer cable 10 is shown in engagement with an S-hook type string holder 38 including an S-shaped hook 40, a cable loop 42, and a crimp sleeve 44. Member 28 is positioned around cable 12 such that end face 36 is in engagement with the crimp sleeve 44 for releasing the tension in bowstring 16 to permit its removal from a normal position in engagement with the hook 40.

Figure 6:
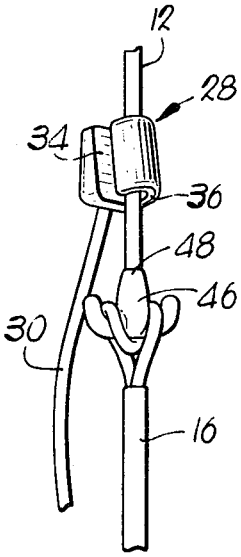
FIG. 6 is a partial elevational view showing the device of FIG. 1 in engagement with an anchor-type string holder.
Figure 2:
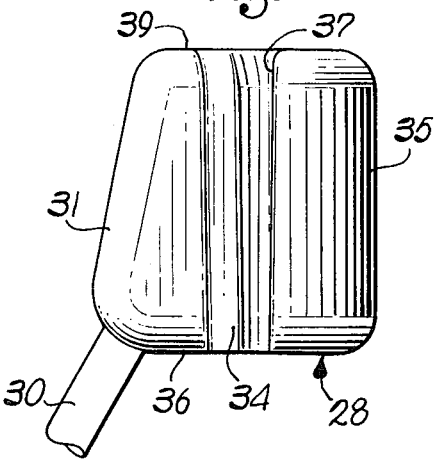
FIG. 2 is an enlarged, partial side elevational view showing one of the engagement members.

In FIG. 6, the cable 10 is shown positioned adjacent another type of string holder; in this instance, an anchor-type holder 46 having structure 48 securing the holder to cable 12. In the position shown, bowstring 16 is still under tension from cable 12 though cable 10 may be positioned to release the tension from string 16 by merely sliding member 28 along cable 12 until end face 36 contacts structure 48.

In use, string changer cable 10 is extended its full length such that members 28 are spaced the maximum possible distance and the cable 10 is then positioned adjacent the worn bowstring 16 of compound bow 14. Each member 28 is placed over respective tension cables 12 at a point just beyond the string holders 24 by moving the cables 12 through slots 34 and into passages 32. Cable 30 is then manually pulled away from handle 18 in a direction corresponding to the draw action of the compound bow. This movement will cause members 28 to move along the respective tension cables 12 until end faces 36 come into contact with structure 25 whereupon further movement of the members will be restricted. At this point, tension in cables 12 is gradually imparted to cable 30 and released from bowstring 16. This action is continued until all of the tension in bowstring 16 is released, whereupon loops 26 are removed from engagement with string holders 24 to free string 16 from the compound bow 14. The operator then allows cable 30 to return to an undrawn position wherein cable 30 assumes one of the normal functions of bowstring 16 in restricting further movement of tension cables 12 thereby maintaining the bow 14 in its partially flexed position. When it is desired to replace string 16 or emplace a new string 16, the cable 30 is merely again moved to a drawn position whereupon loops 26 are positioned over the respective string holders 24. Cable 30 is released from its drawn position, causing tension to gradually be transferred from cable 30 to string 16 until there is no longer any tension in cable 30. At this point, members 28 are simply removed from their position surrounding respective tension cables 12 and bow 14 is ready for use with bowstring 16 properly emplaced thereupon.

The operation of the string changer cable is substantially the same irrespective of the particular configuration of the string holder; that is to say, in the example shown, the string changer cable 10 would work equally as well, and in the same manner, whether the bow 14 is provided with string holders 24, string holders 38, or string holders 46. This is, of course, a significant improvement over the string changers provided by the prior art which are capable of operating only upon compound bows having string holders corresponding to holders 38. The device of the present invention provides a safe and efficient means for changing the bowstrings on compound bows irrespective of the particular type of string holder utilized in the construction of the compound bow.

Having thus described the invention, what is claimed as new and desired to be secured by Letters Patent is:

1. A bowstring changer for use with a compound bow of the type having the bowstring normally stretched between two oppositely biased tension cables and releasably coupled at opposite ends to the cables, said changer including:

a pair of normally spaced, substantially tubular members each having a generally cylindrical passage and a generally axially extending slot formed in the wall of said member, each said slot being in communication with the passage for permitting selective placement of the tubular member around a respective tension cable, each of said members having a face at one end of their respective passages for abutting against a holder on respective ends of each tension cable when the changer is positioned to join the cables; and means for connecting and limiting the maximum spacing between said members to a predetermined distance, said last mentioned means, when connected to tension caables, permitting a strung bowstring to be removed from holders on the ends of the tension cables.

2. A device as claimed in claim 1, wherein said limiting means is secured to each of said members laterally of said cylindrical passage on one end of each of said members.

3. A device as claimed in claim 2, wherein said limiting means comprises a length of flexible cable.

4. A device as claimed in claim 3, wherein said flexible cable is mounted on each of said members obliquely relative to the respective longitudinal axes of each said cylindrical passages.

5. A device as claimed in claim 4, wherein said cylindrical passages are tapered in a direction toward said one end.

* * * * *